US005097905A

United States Patent [19]

Goodwin

[11] Patent Number: 5,097,905

[45] Date of Patent: Mar. 24, 1992

[54] CENTRALIZER FOR WELL CASING

[75] Inventor: Korwin J. Goodwin, Fort Worth, Tex.

[73] Assignee: Mobil Oil Corporation, Fairfax, Va.

[21] Appl. No.: 646,293

[22] Filed: Jan. 28, 1991

[51] Int. Cl.[5] ..... E21B 17/10

[52] U.S. Cl. ..... 166/378; 166/213

[58] Field of Search ..... 166/206, 213, 210, 241, 166/378, 382, 134, 139; 175/325

[56] References Cited

U.S. PATENT DOCUMENTS

| | | | |
|---|---|---|---|
| 1,801,334 | 4/1931 | Dalldorf et al. | 166/213 |
| 2,311,768 | 2/1943 | McCray | 166/213 |
| 2,368,737 | 2/1945 | Badgley | 166/241 |
| 3,292,705 | 12/1966 | Hall, Sr. | 166/241 |
| 3,614,139 | 10/1971 | Harrison | 166/241 |

FOREIGN PATENT DOCUMENTS

| | | | |
|---|---|---|---|
| 1362814 | 12/1987 | U.S.S.R. | 166/139 |

*Primary Examiner*—Thuy M. Bui

*Attorney, Agent, or Firm*—Alexander J. McKillop; Charles J. Speciale; George W. Hager, Jr.

[57] ABSTRACT

An improved centralizer for well casing, comprising an externally threaded upper anchor fixed to the casing, an upper collar threaded to the upper anchor, a lower anchor fixed to the casing, a lower collar bearing against said lower anchor, and a plurality of relatively flexible metallic straps extending between the collars. The centralizer is assembled over a section of well casing as the casing is lowered into the well. When the casing reaches its final depth, it is rotated so that the anchors rotate with the casing, while the collars and the straps remain stationary, as the straps engage the wellbore. When the casing is thus rotated, the upper collar moves along the threads of the upper anchor towards the lower collar, axial movement of which is prevented by the lower anchor. This forces the straps to bulge outwardly away from the casing, urging the casing toward the center of the borehole.

13 Claims, 3 Drawing Sheets

CENTRALIZER FOR WELL CASING

FIELD OF THE INVENTION

This invention relates to an improved centralizer, principally for centering sections of pipe used as well casing prior to cementing.

BACKGROUND OF THE INVENTION

It is commonplace in the well completion art to provide "centralizers" at spaced intervals along the length of a section of well casing to prevent the casing from directly contacting the wellbore. More particularly, in the completion of oil and gas wells, and particularly in formations which are not well consolidated, it is commonplace to "cement" the well by pumping concrete around the casing of the well so as to fill the space between the casing and the formation. This has the effect of sealing the wellbore against fluid or gas migration, and consolidates the formation in the vicinity of the well, rendering the well much more stable. The casing and the cement are then "perforated" where it is desired to produce the well, by detonation of explosive charges within the casing at corresponding points.

It is somewhat unusual that the casing of a well is disposed in the precise center of the wellbore. Commonly, the wellbore is not truly vertical, either due to unavoidable influences in the drilling operation or by design. Therefore, when the casing is lowered into the well, one side of the casing normally rests against the lower side of the wellbore. When the well is subsequently cemented, an insufficient amount of cement is pumped between this part of the casing and the wellbore, and the annular space therebetween is not suitably sealed at this point.

To avoid this problem, so-called "centralizers" are commonly employed. Centralizers as conventionally employed usually consist of two steel collars spaced from one another along the casing by on the order of two feet. Six or eight straps of relatively heavy gauge spring steel which are bent outwardly in a gentle bow shape are welded between the two collars. The centralizers may slide along the length of the casing between the couplings which join sections of the casing, or may be fixed thereto by means of "stop collars" setscrewed to the casing. Such centralizers provide "standoff", that is, a locally increased diameter for the casing, spacing the remainder of the casing from the wellbore. S centralizers are very commonly used in well completion in weakly consolidated or unconsolidated formations, to ensure that cement forms a complete annulus between the casing and the wellbore.

While the use of centralizers as thus described is entirely conventional, there are some inherent problems with use of these devices. Such centralizers are of larger diameter than the remainder of the casing, which can lead to difficulty in passing the casing down the wellbore with the centralizers attached. More specifically, the spring steel bows of centralizers intended to fit on "downhole" sections of casing are normally formed to provide a local outside diameter greater than the inside diameter of a section of "uphole" casing, and greater than the diameter of sealing surfaces provided by conventional casing "hangers". The centralizer bows can damage these sealing surfaces while the casing is lowered into the wellbore; in some cases the centralizers must be eliminated. It would be preferable if effective centralizers could be provided which when lowered are of no greater diameter than the couplings which join the sections of pipe making up the casing, but which can be caused to assume a larger diameter when in the well, forcing the casing toward the center of the wellbore.

SUMMARY OF THE INVENTION

It is therefore an object of the invention to provide an improved centralizer which, as do the prior art centralizers, effectively provides a locally increased diameter of the casing to center the casing in the wellbore, but in which the effective diameter of the centralizer is increased only after the casing has been lowered into the well. This substantially eliminates snagging of the improved centralizers on the wellbore or the like, simplifying their use.

The improved centralizer according to the invention comprises upper and lower anchors. The anchors are rings which can be setscrewed or otherwise fixed to the casing. The upper anchor is threaded on its outer surface, and an upper collar is threadedly attached to the upper anchor. A lower collar fits around the lower anchor, and comprises a shoulder which bears against the bottom anchor. A plurality of spring steel straps extend between the collars. When the improved centralizer is assembled over the casing, the collars are spaced such that the metal straps lie essentially flat alongside the casing section.

When the casing is in its final position, the entire string of pipe is rotated. Friction between the metal straps and the wellbore obliges the straps to remain stationary while the casing turns. By virtue of the threaded connection between the upper anchor, which rotates with the casing, and the upper collar, which is stationary, the upper collar is forced toward the lower collar. The lower collar bears against but rotates with respect to the lower anchor. Thus the ends of the metal straps are brought axially toward one another. This causes the metal straps to bow outwardly, engaging the wellbore and forcing the casing toward the center of the wellbore. After completion of this operation, the casing is spaced from the wellbore at all points around the well.

In a particularly preferred embodiment, spiral vanes may be disposed between the anchors so as to impart a spiral rotation to any cement or the like pumped around the centralizer. The centralizer and vanes may be provided as a complete assembly over a section of tubing which slides over the casing and is fixed thereto.

BRIEF DESCRIPTION OF THE DRAWINGS

The invention will be better understood if reference is made to the accompanying drawings, in which.

BRIEF DESCRIPTION OF THE PREFERRED EMBODIMENTS

Figure 1:
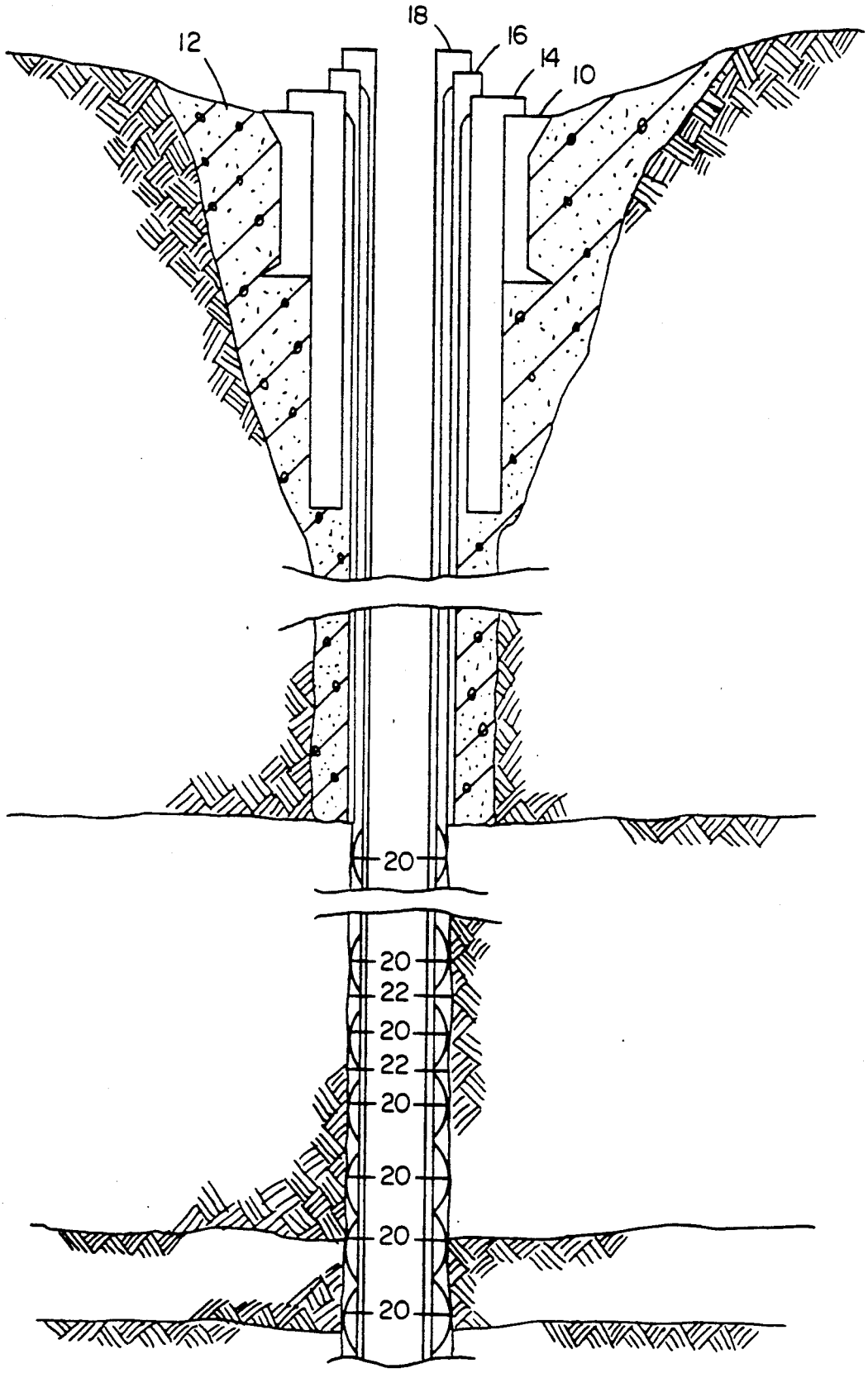
FIG. 1 shows schematically a cross sectional view of a well in the earth and illustrates the use of centralizers according to the invention.

FIG. 1 shows as mentioned a cross sectional view of a typical well drilled in the earth. As shown, the well casing typically includes four or more sections of varying diameter. A largest section 10 at the surface of the earth or in the ocean floor as shown is sometimes referred to as conductor casing and may typically be 26 inches in diameter and between 50 and 500 feet long. Normally, a relatively large quantity of cement 12 is pumped around the conductor casing 10, to insure a very solid foundation for the later casings. A typical next inner section of casing 14, referred to as the surface casing, may be 16 inches in diameter and be between 1000 and 3000 feet long. This also may be cemented in place as shown. Typically this is done by dropping the surface casing 14 down into the conductor casing 10 and pumping cement outwardly around the surface casing, so the cement flows upwardly into the wellbore around the casing. The same steps are then taken with one or more sections of intermediate casing 16. The well is finally completed with the addition of a production casing 18 (or "production liner") which may be on the order of four to eight inches in diameter and may extend from the surface (as shown) or from a point above the lower end of the intermediate casing, to the bottom of the well.

It is customary to space at least the production casing 18 from the wellbore 22 by one or more centralizers. As conventionally employed, these centralizers comprise two collars spaced from one another on the order of two feet along the casing, with preformed spring steel straps bowed outwardly on the order of one to two inches from the outer wall of the casing extending between the collars. Because the straps are bowed outwardly far enough to space the casing from the wellbore, obviously the bowed straps must be somewhat larger in diameter than the casing itself. This can lead to difficulty in lowering the casing 18 into the well, because the wellbore is never completely uniform, and can also lead to difficulties in handling the casing at the upper end of the well. In particular, normally the outside diameter of the lowered straps is greater than the inside diameter of the intermediate casing 16, to centralize the casing. Friction between the straps and the inside of the intermediate casing 16 impedes the lowering of the production casing 18. The straps can also gouge the sealing surfaces of conventional "casing hangers" (not shown), which are intended to seal the wellbore against the outer surface of the production casing.

Figure 2:
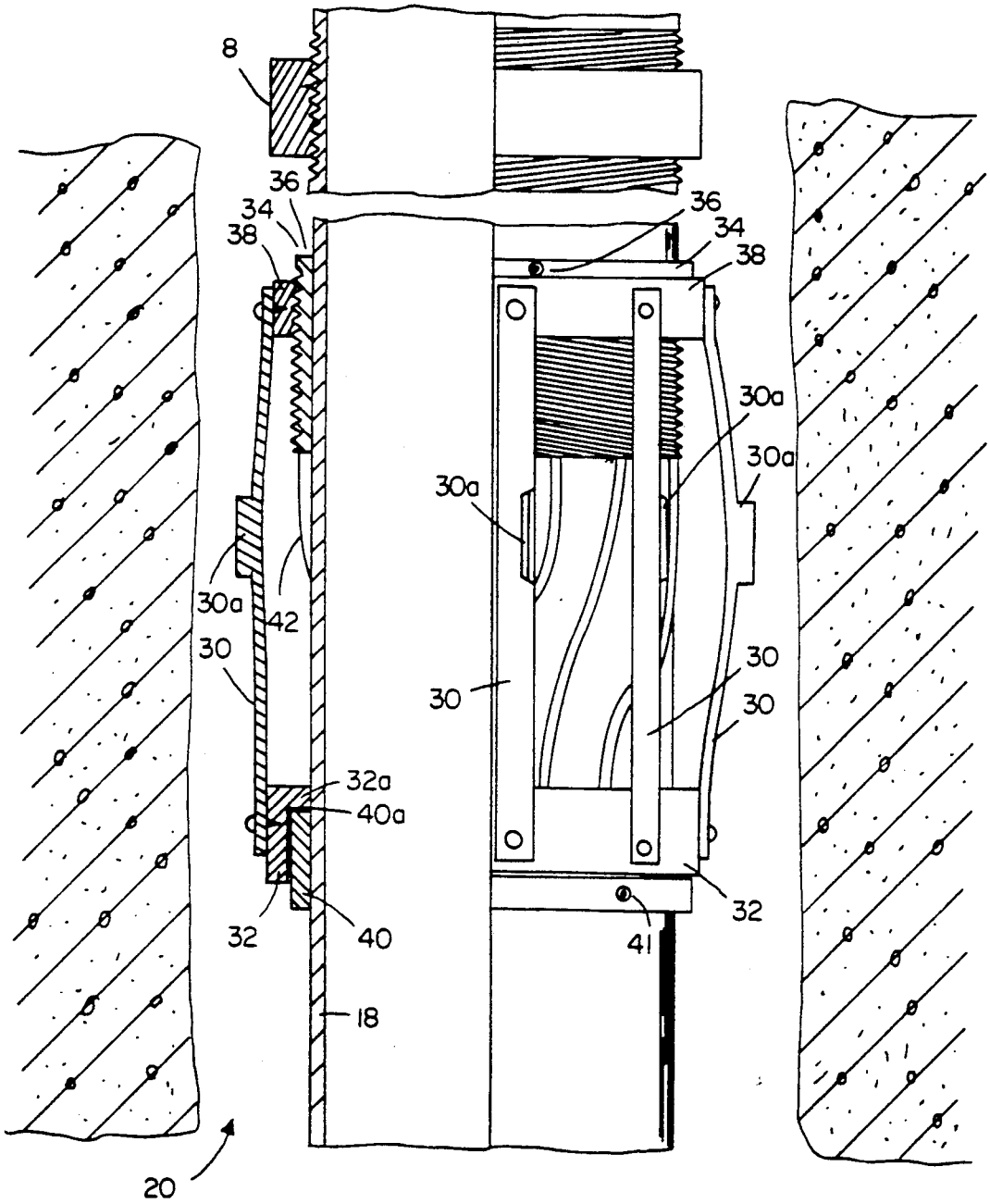
FIG. 2 shows a half cross section/half elevation view of an improved centralizer according to the invention in a wellbore, prior to its expansion to an effective diameter.
Figure 3:
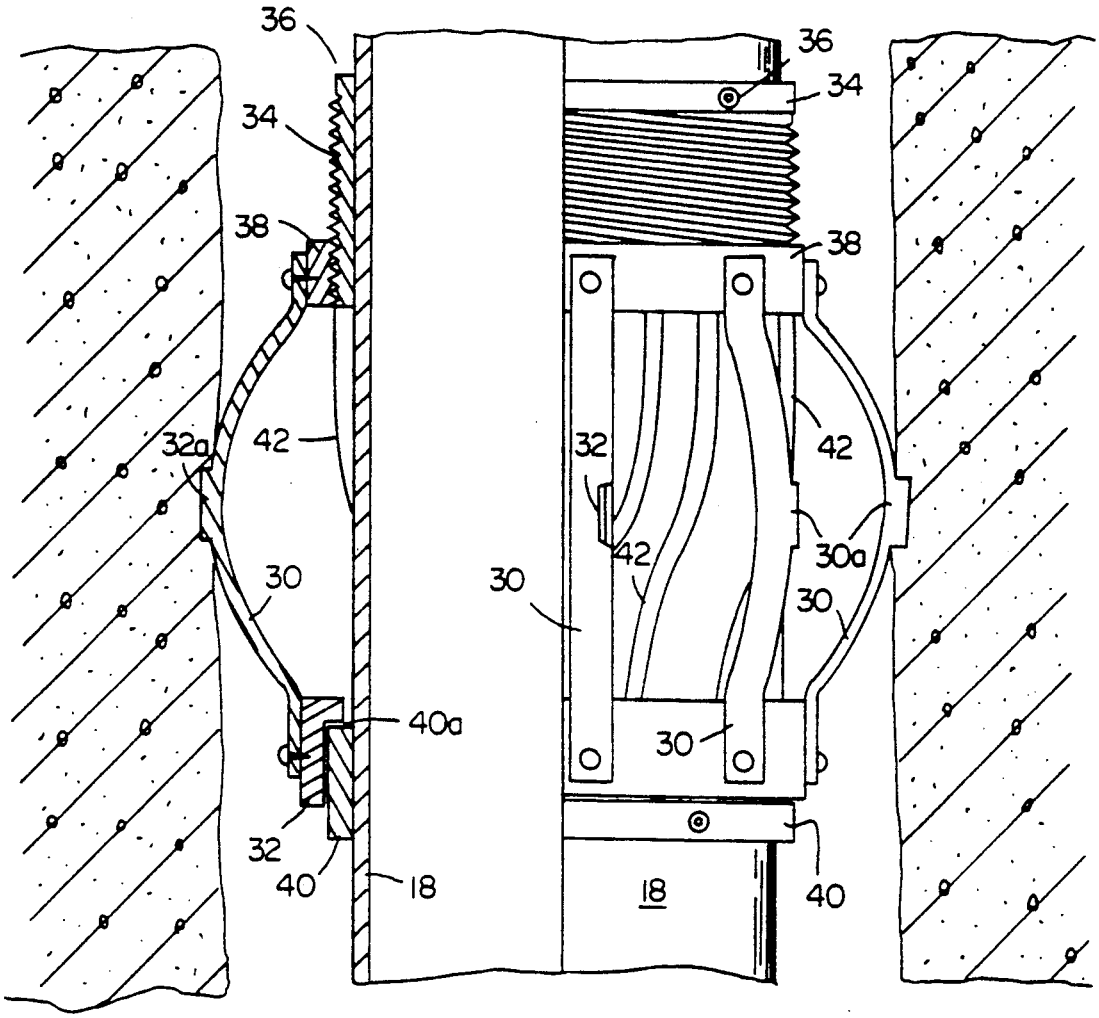
FIG. 3 shows views comparable to those of FIG. 2 of the centralizer in the expanded configuration.

According to the invention, therefore, an improved centralizer is provided. When lowered into the well, the improved centralizer 20 is essentially of the same diameter as the couplings by which sections of the casing are joined to one another; it is later expanded to space the casing away from the wellbore, as depicted in FIG. 1. FIG. 2 shows on its left side a cross sectional view of a centralizer according to the invention and on the right side an elevational view of such a centralizer according to the invention, both with the centralizer in its "contracted" condition, while FIG. 3 shows corresponding views of the centralizer according to the invention after its activation, showing how the straps thereof have bulged outwardly to engage the wall of the wellbore and urge the casing toward the center of the wellbore.

As shown in FIG. 2, the casing 18 essentially comprises sections of steel pipe which are joined, e.g., at twenty or thirty foot intervals, by threaded couplings 8. The centralizer 20 of the invention comprises a lower collar 32 which fits around the casing and is free to rotate with respect to the casing 18. The lower collar 32 includes a bearing shoulder **32*a* which rides on a corresponding bearing surface 40*a* on a lower anchor 40. The lower anchor 40 is fixed to the casing 18. Therefore, the lower collar 32 is free to rotate with respect to the casing 18, but is prevented from axial movement therealong in one direction (i.e., downwardly in FIG. 2) by the lower collar 40**.

Preferably, the lower anchor 40 and an upper anchor 34 discussed below are fixed to the casing by setscrews 41 and 36 respectively. They could also be welded to the casing. However, to prevent corrosion of the casing at the weld, preferably the anchors are setscrewed to the casing.

The centralizer 20 also comprises a second upper anchor 34 which is threaded on its outer surface and is fixed to the casing, again by set screws 36. An upper collar 38 is threaded over the upper anchor 34. One end of a number (e.g. six or eight) of steel straps 30 are fixed to the upper collar 38; the other ends of the straps 30 are fixed to the lower collar 32. The straps 30 can be joined to the collars by rivets or pins as shown schematically, may be welded thereto, or otherwise. However, the joining method employed must provide a rigid connection, so that the straps remain essentially perpendicular to the collars and do not twist about the casing under compression.

The straps of the prior art centralizers were preformed in their desired bowed configuration. These straps were formed of spring steel, so that they could "give" in response to relatively heavy loads encountered in lowering the casing. By comparison, the straps 30 of the centralizer of the invention are formed with only a slight outward bulge, as shown in FIG. 2, to ensure that they do not buckle inwardly in use. However, the straps according to the invention are formed of spring steel essentially similar to that used in the prior art, so as to buckle outwardly upon exertion of moderate axial force thereon.

Conventionally, the sections of casing 18 are joined by right-hand threaded pipe couplings 8. To allow activation of the centralizer of the invention by rotation of the casing without unscrewing the casing from the coupling, the upper anchor 34 and the upper collar 38 are joined by left-hand threads. According to the method of use of the invention, the anchors 34 and 40 of the centralizer 20 as shown in FIG. 2 are fixed to the casing 18 as the sections of casing are lowered into the well. When the casing is fully lowered into the well, typically one or more of the straps 30 of each centralizer 20 will be engaged with the wellbore, as indicated on the left side of FIG. 2. Fins or enlarged radially-extending sections **30*a*** may be formed on the straps to insure the straps are firmly engaged by the wellbore, and to provide torsional rigidity, so that they do not twist.

In order to activate the centralizer according to the invention, causing the straps 30 to bulge outwardly to take the position shown in FIG. 3, the entire casing is then rotated clockwise (viewing the assembly from above) so that the upper collar 38 is caused to move axially along the casing toward the lower collar 32. That is, the upper anchor 34, being fixed or fastened with set screws to the casing, rotates, while the upper collar 38, being fixed to the straps 30 which engage the wellbore as shown, is stationary. Accordingly, as the casing is rotated, the upper collar 38 moves axially along the threads of the upper anchor 34, toward the lower collar 32, which is prevented from axial movement by the lower anchor 40. The straps 30 accordingly bulge outwardly, urging the casing toward the center of the wellbore, as shown in FIG. 3.

The ultimate purpose of the centralizer is to space the casing 18 from the wellbore so that cement can be pumped around the casing on all sides, consolidating the formation in which the well is drilled, and sealing the wellbore to the casing. To insure that the cement flows evenly upwardly from the lower end of the casing around it, it may be desirable to provide vanes 42 on the casing between the anchors. These can be simple sections of square steel bar stock, curved into a spiral shape and fixed to the anchors.

Figure 4:
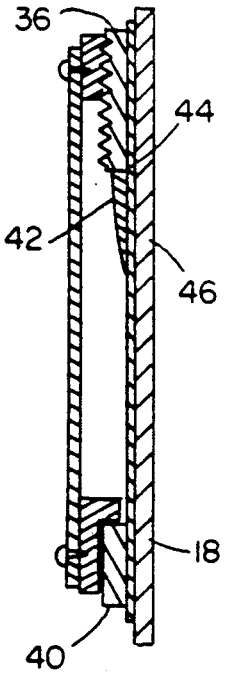
FIG. 4 shows a partial cross sectional view of an alternative embodiment of the centralizer of the invention.

FIG. 4 shows a further embodiment of the invention which may prove useful in saving time in the field. The only difference between this embodiment and that of FIGS. 2 and 4 is the interposition of a second tubular member 44 to which the anchors 36 and 40, and the deflector vanes 42 if used, are welded or otherwise affixed. In this way, the entire centralizer assembly is completely assembled over the tube 44, which needs merely to be fixed to the casing 18 by set screws or the like, to complete the assembly according to the invention.

Numerous modifications and improvements to the invention will occur to those of skill in the art, and the invention should be construed to include these. Reference herein to "upper" and "lower" collars and anchors in particular should not be construed to limit the invention to the orientation described. This terminology is employed herein only in order to provide a clear description of the invention. Therefore, while a preferred embodiment of the invention has been disclosed, this should not be taken as a limitation on its scope, which is to be limited only by the following claims.

I claim:

1. An improved centralizer for centering a well casing in a wellbore, comprising:

a first anchor adapted to fit around and be securely fixed to said casing, said first anchor being threaded on its external surface;

a first collar adapted to fit around and be threadedly engaged by said first anchor;

a second collar adapted to fit around and free to rotate and move axially with respect to said casing;

a second anchor adapted to fit around and be securely fixed to said casing spaced from said first anchor and comprising a bearing surface for restraining axial movement of said second collar along said casing; and a plurality of metallic straps extending between said first collar and said second collar, and being securely fixed to each.

2. The centralizer of claim 1, wherein said straps are substantially similar to one another, and are formed of substantially continuous members of spring steel.

3. The centralizer of claim 1, wherein said straps are formed to comprise members extending radially outwardly away from the casing so as to tend to engage the wellbore.

4. The centralizer of claim 1, wherein said straps are formed with a slight outward bow to ensure that they buckle outwardly under axial compression.

5. The centralizer of claim 1, wherein said casing is formed of pipe sections joined by threaded couplings of particular handedness, and said first collar and first anchor are engaged by threads of the opposite handedness.

6. The centralizer of claim 1, in combination with a plurality of vanes extending along but at an angle to said casing, beneath said metallic straps, for directing materials flowing between said casing and the wellbore along a generally spiral path.

7. The centralizer of claim 6 wherein said vanes are fixed to a tubular member fitting over said casing, to which tubular member said anchors are also fixed.

8. Method for centralizing a casing in a wellbore, comprising the steps of:

assembling a plurality of centralizers over sections of the casing as they are lowered into the wellbore, each of said centralizers comprising:

a first anchor adapted to fit around and be securely fixed to a section of said casing, said first anchor being threaded on its external surface;

a first collar adapted to fit around and threadedly engage said first anchor;

a second collar adapted to fit around and free to rotate and move axially with respect to said casing;

a second anchor adapted to fit around and be securely fixed to said casing, spaced from said first anchor, said second anchor comprising a bearing surface for restraining axial movement of said second collar along said casing; and a plurality of elongated metallic straps extending between said first and second collars, and being securely fixed to each;

fixing said anchors to the casing sections;

lowering said casing to a final position within the wellbore, in which one or more of said straps engage the wall of the wellbore; and rotating said casing such that said first collar is rotated with respect to said first anchor and approaches said second collar, whereby said straps bulge outwardly, urging said casing toward the center of the wellbore.

9. The method of claim 8 wherein said straps are substantially identical to one another, and are formed of spring steel.

10. The method of claim 8, wherein said straps are formed to comprise portions extending radially outwardly away from the casing so as to tend to engage the wellbore.

11. The method of claim 8, wherein said straps are formed with a slight outward bow to ensure that they buckle outwardly under axial compression.

12. The method of claim 8, wherein said casing is formed of pipe sections joined by threaded couplings of particular handedness, and said first collar and first anchor are joined by threads of the opposite handedness.

13. The method of claim 8, comprising the further step of cementing the casing within the wellbore after centralizing the casing therein.

* * * * *